US005775848A

United States Patent [19]

Blankinship et al.

[11] Patent Number: 5,775,848

[45] Date of Patent: Jul. 7, 1998

[54] EARTH AND ROCK ANCHORING DEVICES

[75] Inventors: Willis J. Blankinship; Daniel V. Hamilton, both of Centralia; Stephen W. Odneal, Columbia, all of Mo.

[73] Assignee: Hubbell Incorporated, Orange, Conn.

[21] Appl. No.: 724,256

[22] Filed: Sep. 30, 1996

[51] Int. Cl.[6] ..... E02D 5/74

[52] U.S. Cl. ..... 405/244; 52/155; 52/160; 206/497; 405/259.1; 405/259.6; 411/78

[58] Field of Search ..... 405/244, 259.1–259.6, 405/302.1–302.2; 206/497; 52/153–165; 411/377; 220/23.4

[56] References Cited

U.S. PATENT DOCUMENTS

| | | | |
|---|---|---|---|
| 1,853,400 | 6/1932 | Bierce . | |
| 1,942,684 | 2/1934 | Chance . | |
| 1,992,651 | 12/1935 | Winterset . | |
| 2,177,138 | 12/1939 | Hollander et al. . | |
| 2,279,918 | 5/1942 | Fee et al. . | |
| 2,490,355 | 2/1949 | Hubbard . | |
| 2,570,646 | 3/1951 | Cole . | |
| 2,640,571 | 4/1953 | Harper . | |
| 3,675,765 | 7/1972 | Melsek | 206/497 X |
| 3,964,605 | 6/1976 | Vezirian | 206/497 X |
| 4,386,697 | 6/1983 | Zocher | 206/497 X |
| 4,763,783 | 8/1988 | Talbot | 206/497 X |
| 5,499,711 | 3/1996 | Kozak | 206/497 X |
| 5,527,062 | 6/1996 | Kreuzer | 206/497 X |

*Primary Examiner*—Dennis L. Taylor

*Attorney, Agent, or Firm*—Jerry M. Presson; Leopold Presser

[57] ABSTRACT

Anchoring devices for securing diverse types of structures to the earth or soil, or to rock walls and formations, such as are frequently employed for anchoring gas and petroleum-product pipelines, guy-supported towers, utility poles, large-sized retaining walls and building foundations, among numerous other types of application. In order to render each of the above-described anchoring devices more user-friendly and compatible with the environment, while facilitating the installation thereof in the applicable bore holes, drilled holes or earth trenches, while also reducing the production and assembling steps required in the manufacture of the various anchoring devices, a suitable retentive encompassing packaging structure tightly encases each of the anchoring devices which will maintain the components of the respective anchoring devices in their assembled pre-installed and retracted condition.

15 Claims, 5 Drawing Sheets

Drill hole by hand ...or with power tool ...push anchor into hole ...turn rod to expand.

EARTH AND ROCK ANCHORING DEVICES

BACKGROUND OF THE INVENTION

1. Field of the Invention

The present invention relates to anchoring devices for securing diverse types of structures to the earth or soil, or to rock walls and formations, such as are frequently employed for anchoring gas and petroleum-product pipelines, guy-supported towers, utility poles, large-sized retaining walls and building foundations, among numerous other types of application.

The utilization of different kinds of anchors for securing diverse structures to the earth; in effect soil, or to rocks concerns technology which has been developed over a period of many years. In earlier times, anchoring devices for securing diverse structures to the earth or ground were convenient trees which could form the basis for tying up a boat, securing a structure, or animal. Thereafter, with the clearing of land and the dearth of any conveniently available trees, wooden stakes which were driven into the ground were frequently employed to form such anchoring devices. Later on, with heavier loads having to be supported, buried logs or a so-called "log deadman" were employed, and other types of anchors were formed to simulate tree roots, frequently consisting of steel or the like, essentially the forerunners of present anchoring devices which; however, did not provide the required strength to secure heavy structures which were subjected to intense loads or stresses. Other early devices for anchoring large and occasionally highly stressed structures to the earth included screw-type stakes and piles which were driven into the ground; none of which, however, where considered to be adequate in meeting the tasks imposed thereon.

Over the years, more sophisticated anchoring devices were developed which, to an ever-increasing degree, fulfilled the requirements in securely anchoring the above-mentioned kinds of structures to the earth or to rock.

2. Discussion of the Prior Art

For instance, an expanding earth anchor which is currently employed is disclosed in Cole U.S. Pat. No. 2,570,646, and which provides a simple anchoring device for securing cables or the like to earth by incorporating a plurality of metal blades formed in an essentially cup-shape from a single sheet of metal and supported on a base element, which upon being inserted into a hole previously bored into the earth or soil, may be struck from above with a tamping bar or slide hammer so as to expand and flatten the metal blades radially outwardly to thereby extend into and grippingly engage the undisturbed soil proximate the bottom of the bore hole. A suitable wire or cable is adapted to be connected to the expanded anchor so as to form a guying arrangement for securing a particular structure to the ground.

Another type of expandable anchor consists of a so-called pole key anchor which is adapted to be inserted into a hole dug into the ground housing pole so as to be located adjacent one side of the pole, and expanded to form a pole supporting structure. Preferably, a similar expanding pole key anchor is installed in the hole in the earth on the opposite side of the pole at a higher elevation closer to the ground surface so as to, in cooperation with the other anchor, support the pole against bending moments imposed thereon. A pole key anchor of this type may be readily ascertained from Harper U.S. Pat. No. 2,640,571, also assigned to the present assignee, and serves to satisfactorily anchor a pole, such as a utility line pole or the like, in the ground.

A further type of anchoring device comprises an expanding rock anchor in which an essentially cylindrical structure including radially outwardly expandable wedges is adapted to be inserted into a hole drilled into rock or rock formations, and then expanded by means of a suitable turning rod and screw structure, thereby causing the wedge surfaces to radially expand and grippingly engage the wall of the drilled hole. A guy wire may then be secured to the upper end of the rod which was utilized for expanding the wedges of the rock anchor, so as to form a guying structure for securing line poles or other types of structures.

Another earth anchor may be in the form of a so-called cross-plate construction in which a pair of superimposed plates are fastened oriented at right angles to each other, inserted into a trench formed in the earth and with a rod extending perpendicularly thereto anchoring the cross plates and the rod extending therefrom in that the trench is backfilled to securely anchor the cross plates in the ground.

In essence, although all of the above-described anchoring devices fulfill to a satisfactory degree their intended applications in anchoring the most diverse types of structures to the ground or to rock, some drawbacks and limitations have been encountered in the complexity of manufacturing and assembling of the anchoring devices and, in some instances, during the installing of these devices in the ground or in holes drilled in rock.

For instance, the expanding earth anchor which comprises a plurality of radially expandable wedge-like blades which are formed from a single metallic sheet, and wherein the latter is mounted or rests on a base having a threaded aperture for convecting a guying wire or pole for inserting the anchor into a bore hole in the earth, since the expandable wedge-like blades and the base are separate elements, these must be interconnected through the intermediary of securing wires which are subsequently broken upon expansion of the blades. Furthermore, the expanding anchor is ordinarily coated with an asphalt paint; basically comprising a bituminous composition consisting of a mixture of asphalt and drying oil. The asphalt paint is primarily provided to enable the metallic material of the anchor to resist rusting during shipping and storing and is not intended to be effective after installation in the soil or rock. The handling by installing personnel of such an earth anchor frequently causes the asphalt paint to adhere to and soil the installer' clothing and hands, such paint being difficult to remove through suitable cleansing media.

Moreover, the interconnecting of the expandable wedge or blade portion and base of the earth anchor by means of the connecting wires, the latter of which are subsequently separated through the tamping of the anchor in the bottom of the bore hole to expand the wedge-like blade portions, requires intensive manual labor in inserting the wires through suitable drilled holes in the tip portions of the blades and the base, and in the coating of the anchor surfaces with the asphalt paint. Moreover, inasmuch as the components consisting of the blade or wedge-forming sheet metal and base are only loosely held together by the connecting wires, during insertion into the previously formed bore hole in the earth, the components tend to wobble or shift relative to each other, at times causing hang-up between the wall of the bore hole and the sharp-pointed edges or tips of the somewhat tiltable wedge or blade components of the anchor; while the sharp edges may also be considered a possible physical hazard to the person handling the expanding anchor during its manufacture and assembly and to the personnel engaged in the installation thereof in the bore hole.

With respect to the expanding pole key, the mutually expandable plate components are held together prior to installation in the ground and expansion thereof by means of suitable wires, and with the overall surface structure of the pole key being covered with the asphalt paint.

Similarly, the expandable rock anchor has the surfaces thereof covered with the asphalt paint, and in order to prevent the wedges from loosening and radially expanding prior to and during insertion into the hole which has been drilled into the rock, a retaining wire is ordinarily wound thereabout, and the anchor structure covered with a burlap cloth, rendering the entire arrangement somewhat unattractive to a customer, while at times making insertion into the drilled hole difficult whereby the anchor may not be fully inserted to the full depth thereof. Frequently, customers may even remove the wire restraining the anchoring wedges in the radially retracted position, and substitute either a thinner wire or a tape, again a cumbersome process which does not render the expanding rock anchor particularly user-friendly or compatible with the environment.

The foregoing also applies to the cross-plate anchor structure, which is also covered with asphalt paint, and with the plate members thereof also being held together by means of rivets to prevent relative pivoting between the plate members during and subsequent to installation in the trench which has been dug in the earth for the purpose of receiving the cross-plate anchor.

SUMMARY OF THE INVENTION

Accordingly, in order to render each of the above-described anchoring devices more user-friendly and compatible with the environment, while facilitating the installation thereof in the applicable bore holes, drilled holes or earth trenches, while also reducing the production and assembling steps required in the manufacture of the various anchoring devices, the present invention contemplates the provision of a suitable retentive encompassing packaging structure which will maintain the components of the respective anchoring devices in their assembled pre-installed and retracted condition.

Thus, pursuant to a particular aspect of the invention, with respect to the expanding earth anchor possessing the expandable wedge-like blades supported on a base, the encasing of the anchor components through the intermediary of a plastic shrink wrap film to retain them in their initial assembled condition prior to installation in the earth eliminates the need for providing wires to retain the base to the sheet metal portion having the expandable wedge-like blades thereon, and also obviates the need for coating the components with environmentally-damaging asphalt paint which leaches into the soil. The covering of the components with a tightly encasing packaging material which is; for example, constituted of the plastic shrink- wrap film, thus maintains the components, such as the base and the expandable wedge-like blade portion in a mutually tightly interconnected position without any other elements; in effect, thereby eliminating the manufacturing steps of having to insert wires through holes in the elements for connecting the components and obviating the necessity of having to paint the external surfaces of the anchoring device with the rust-inhibiting asphalt paint. Moreover, the tight interconnection between the base and the wedge-like expandable anchoring element prevents the previously encountered wobbling between these components during installation into a bore hole, thereby rendering easier the insertion into the bore hole, while the film concurrently covers the sharp and potentially dangerous outer edges of the wedge portion of the anchoring device, resultingly rendering the arrangement user-friendly and environmentally-friendly.

Similarly, with respect to the expanding pole key, this is maintained in its retracted or pre-expanded position by means of the tightly encompassing plastic shrink-wrap film, thereby eliminating the need for wires to initially retain the components in their retracted position, while also obviating the need for coating the surfaces thereof with asphalt paint.

With regard to the expanding rock anchor, there is eliminated the need for having to provide the wire for initially retaining the wedge portions in their retracted position before and during installation in a hole drilled into rock, since this restraining action is now implemented by means of the tightly encompassing plastic shrink-wrap film, and also eliminates the need for the coating of asphalt paint or burlap covering to be provided thereon.

The foregoing inventive aspect also eliminates the need for providing rivets in the cross-plate anchor which normally interconnect the plates thereof in their crossed orientations, inasmuch as the plastic shrink-wrap film causes the plates to be fixedly maintained in their desired relative positions prior to and upon insertion into the earth, thereby eliminating the need for rivets and for forming rivet holes.

In lieu of the plastic film, such as plastic shrink-wrap film, the encompassing packaging material may consist of plastic netting, textile wrap or fabric, which may be utilized in conjunction with asphalt-painting of the anchor surfaces or with waterproof packaging or containers to accomplish the same results.

Accordingly, it is an object of the present invention to provide anchoring devices, such as earth anchors, rock anchors, expanding pole keys and cross-plate anchors and the like which are tightly encompassed by a packaging material, such as plastic shrink-wrap film, plastic netting or fabric, to simplify manufacture thereof while rendering the anchoring devices easier to install user-friendly and environmentally-friendly.

BRIEF DESCRIPTION OF THE DRAWINGS

Reference may now be had to preferred embodiments of the invention, taken in conjunction with the accompanying drawings; in which:

FIG. 11*a* illustrates, the expanded condition of the pole key in the earth, while

DETAILED DESCRIPTION OF PREFERRED EMBODIMENT

Figure 1:
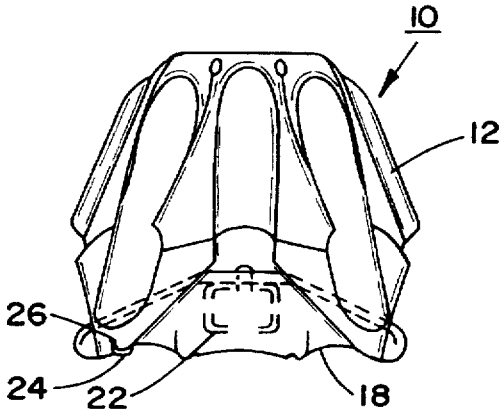
FIG. 1 (PRIOR ART)
FIG. 1 illustrates a side elevational view of an expanding anchor pursuant to the prior art.
Figure 2:
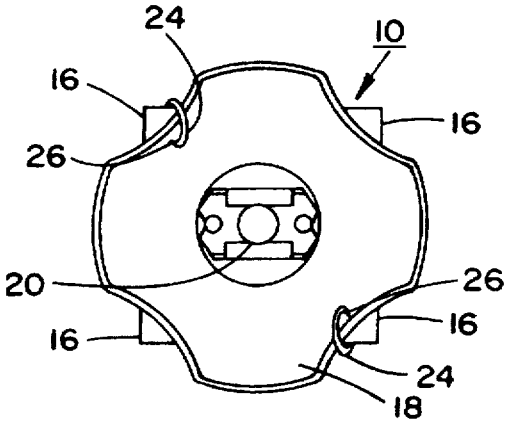
FIG. 2 (PRIOR ART)
FIG. 2 illustrates a bottom view of the expanding anchor of FIG. 1.
Figure 3:
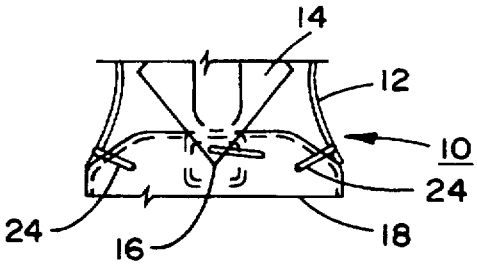
FIG. 3 (PRIOR ART)
FIG. 3 illustrates a partial lower side sectional view of FIG. 1.

Referring now in more specific detail to earth anchors as represented in FIGS. 1 through 7 of the drawings, shown in FIG. 1 is a side elevational view of a presently known expanding earth anchor; similar to that as is disclosed in the above-referenced U.S. Pat. No. 2,570,646; as well as in U.S. Pat. No. 2,658,590. In essence, the expanding earth anchor 10 of FIG. 1 includes an expandable portion 12 consisting of bent sheet metal, so as to form essentially a plurality of expandable blades 14 having sharp outer edges 16 which is loosely superimposed on an in cross-section, generally frusto-conically shaped base element 18, which is also constituted of a similar metal. The base element 18 has in the center thereof a threaded aperture 20, for example in a threaded nut retainer 22 riveted thereto, so as to be able to receive a rod member for inserting the entire earth anchor 10 into a bore hole formed in the earth or ground.

In order to assemble the base 18 and the expandable portion 12 of the known earth anchor with the blades 14 in their downwardly contracted condition, connecting wires 24 extend through aligned drilled holes 26 formed in at least two of the blade tips and in the base 18. The entire surface structure of the earth anchor 10 is coated with an asphalt paint; in essence, a bituminous paint consisting of a mixture of asphalt and a drying oil, as shown in FIG. 4, which forms a protective covering against rusting during shipping and storing of the anchor.

The foregoing earth anchor 10, although satisfactory in the intended use thereof for the numerous applications for which the earth anchor is designed, is not particularly user-friendly in connection with its installation inasmuch as the asphalt paint frequently rubs off, thereby soiling the clothing and hands of the installer, and ultimately contaminating the soil, while the initial wiring of the wedge or blade-containing portion 12 to the base 16 requires extensive manual labor while exposing the sharp edges 16 of each blade which could, conceivably, pose a hazard of possible injuries to the installing personnel. Moreover, the mere fastening together of the base 18 and the blade-containing expandable portion 12 imparts a certain degree of looseness or wobble to be present between the parts while being introduced into the earth through the bore hole, tending to cause the sharp edges to hang up on the wall, and thereby rendering the installation somewhat difficult.

Figure 5:
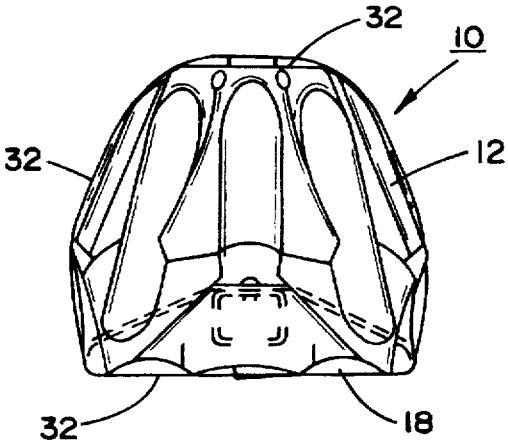
FIG. 5 illustrates the expanding anchor as modified and improved pursuant to the invention.
Figure 6:
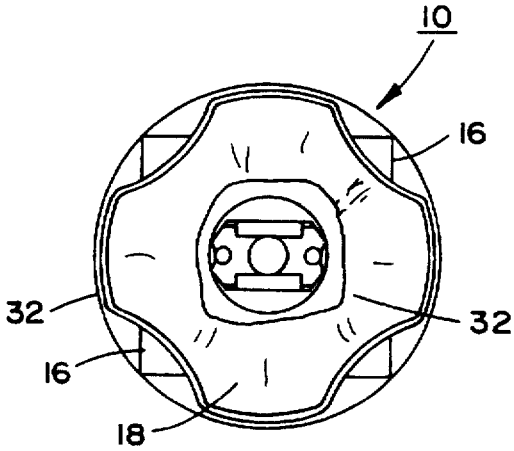
FIG. 6 illustrates a bottom view of the expanding anchor of FIG. 5.
Figure 4:
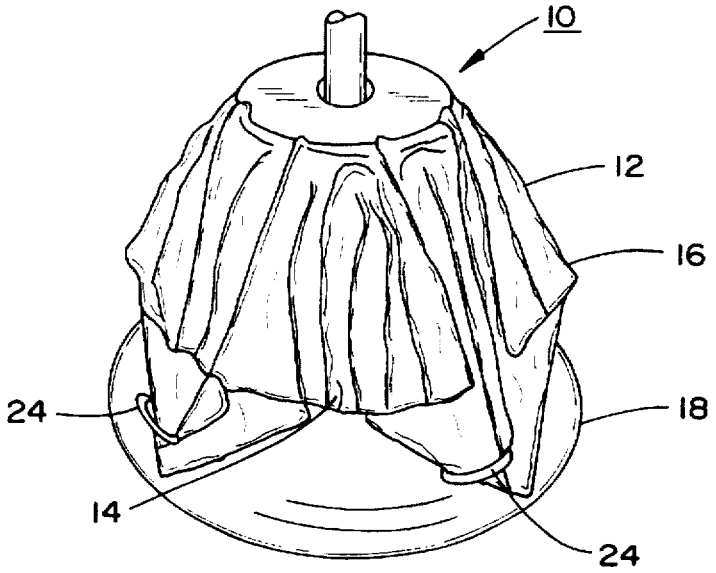
FIG. 4 (PRIOR ART)
FIG. 4 illustrates a perspective side view of the expanding anchor of FIG. 1.

In the inventive modification of the expandable earth anchor 10 as shown in FIGS. 5 and 6, in which identical or similar elements to those in FIG. 1 to 4 are designated by the same reference numerals, the connecting wires 24 of FIG. 4 tying the base 18 and the expandable blade-containing portion 12 together have been eliminated, and the components 12, 18 are firmly assembled and fixedly held together by being tightly encased in a packaging or an enclosure consisting of a plastic shrink-wrap film 32 of desirable thickness and strength for withstanding the stresses and strains generated during shipping and in being forced down into the bore hole. This encasement by the plastic shrink-wrap film 32 tightly encompassing the components eliminates the need for connecting wires 24 and for coating the components with the asphalt paint. Furthermore, the firm interconnection of the components, essentially the base 18 and the expandable blade-containing portion 12, prevents any appreciable relative wobbling therebetween, while protecting the sharp edges 16 from contacting the bore hole or injuring personnel, thereby rendering installation much simpler and making the entire earth anchor user and environmentally friendly, while concurrently reducing manufacturing steps; in effect, eliminating wiring and painting with asphalt paint.

The plastic shrink-wrap film may be constituted of a suitable thermoplastic film material, preferably such as polyethylene, polyvinylchloride, polyester, or polypropylene, as is well known in the plastics industry regarding the use of shrink-wrap film for different kinds of packaging.

In essence, reiterating the foregoing, the use of the plastic shrink-wrap film 32 to interconnect the components 12, 18 prior to installation, eliminates the need for having to paint the surfaces of the earth anchor 10 with asphalt paint, eliminates the need for producing holes 26 and inserting wires 24 to interconnect the components 12, 18, while also rendering easier the installation in the bore hole dug into the ground while protecting any sharp edges 16 from protruding prior to expansion of the expanding anchor responsive to being expanded out by the sliding hammer or tamping tool which will cause the plastic film 32 to first tear in the bottommost position of the anchor 10 within the ground. Moreover, the elimination of the asphalt paint is environmentally protective of the ground since there is no contamination by leaching of the chemicals contained therein.

Figures 7A, 7B:
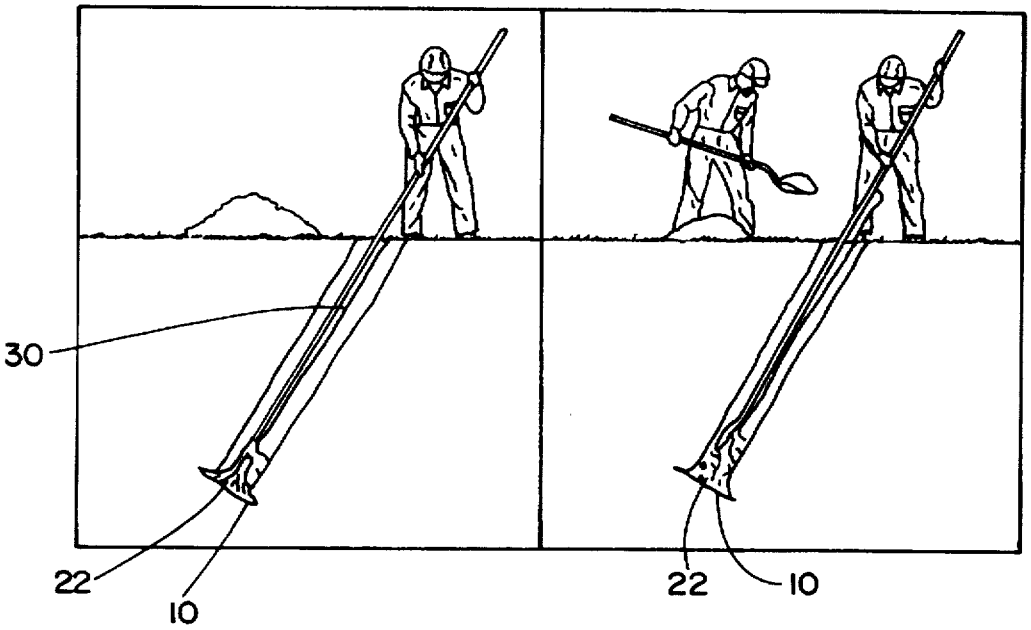
FIGS. 7*a* and 7*b* illustrate, respectively, steps in the process of inserting the expanding anchor of FIG. 5 into a bore hole in the earth.

After a hole commensurate in size with the anchor 10 has been dug in the earth or soil to a predetermined depth, as shown in FIG. 7*a* of the drawings, the expanding earth anchor 10 with an attached rod 30 connected to nut retainer 22 is inserted therein to the bottom of the hole, and by means of a ram or sliding hammer, impacting pressure is imparted to the upper surface of the expandable blade-containing portion 12 so as to flatten the latter, and to expand radially outwardly, as shown in FIG. 7*b*, whereupon the hole, after removing the sliding hammer is filled in or back-filled, while a suitable guy wire or rod extends out of the ground or soil from the threaded nut retainer 22 of the base 18 which is now firmly anchored in the earth.

Heretofore, while impacting the portion 12 to expand the latter, considerable force had to be expanded to separate the wires 24 connecting the components 12, 18. The use of the plastic film 32 obviates this aspect, since only a lesser force is required to rupture the plastic film 32.

Figure 8:
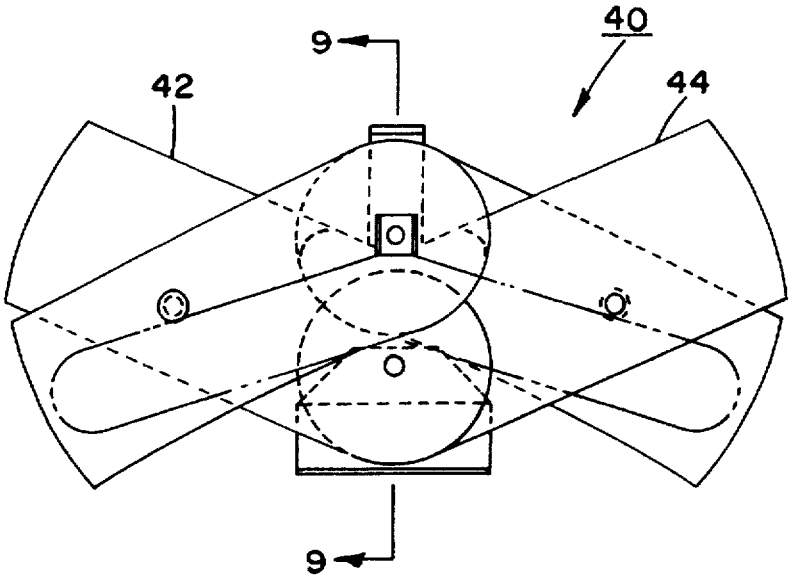
FIG. 8 illustrates a side view of an expanding pole key pursuant to the invention shown in its expanded form.
Figure 9:
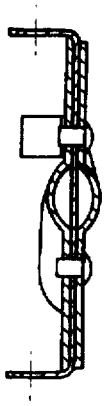
FIG. 9 illustrates a sectional view of the pole key taken along line 9—9 in FIG. 8.
Figure 10:
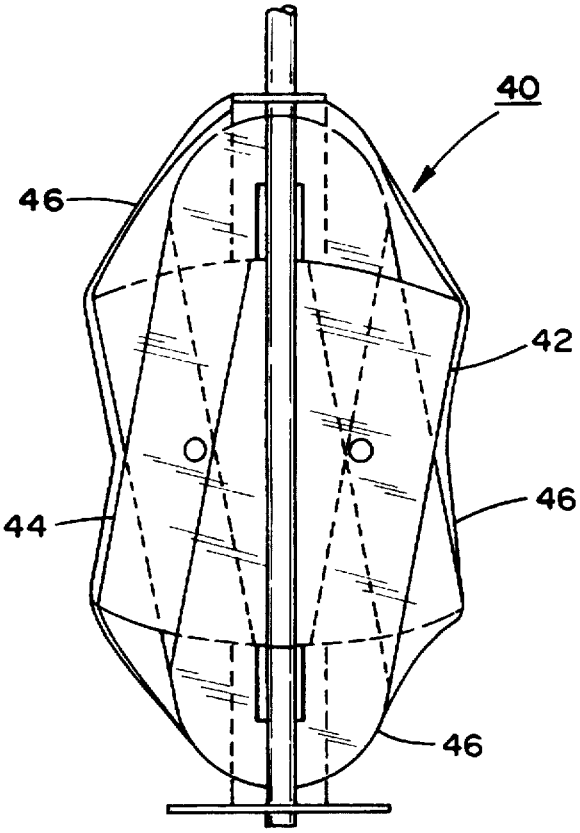
FIG. 10 illustrates, generally diagrammatically, the pole key of FIG. 8 shown in its initial retracted and packaged configuration prior to installation.
Figure 11A:
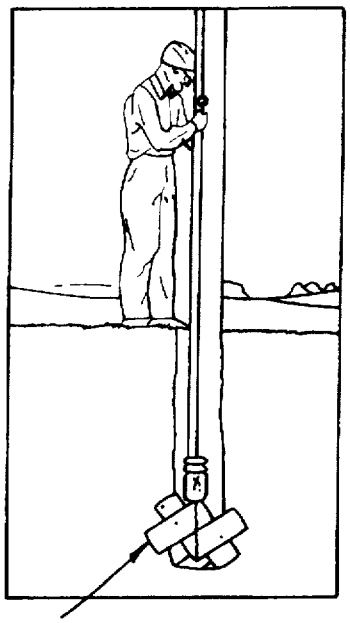
Figure 11B:
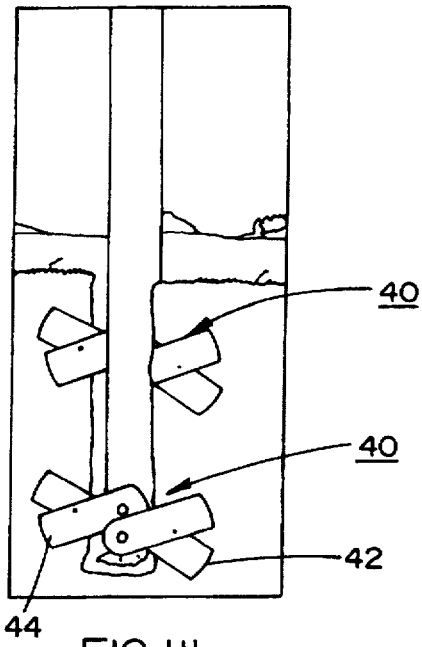
FIG. 11*b* illustrates the expanded position of two pole keys for supporting a pole in the earth.

Reverting to the embodiment of a pole key 40 as is disclosed in FIGS. 8 through 11 of the drawings, and as shown in the expanded condition thereof in FIGS. 8 and 9, as currently used the pole key 40 normally would have the scissors-like plates 42, 44 retained in the closed condition, as shown schematically in FIG. 10, by means of a suitable connecting wire (not shown) and with the entire surface areas thereof being covered with asphalt paint, as in the previous embodiment of FIGS. 1 through 4.

However, pursuant to the inventive concept, the wire for holding the pole key 40 in its shipping closed or retracted position is eliminated, as is also the need for coating its surfaces with the asphalt paint, by simply encasing the entire pole key structure in the retracted condition shown in FIG. 10 with plastic shrink-wrap film 46, thereby rendering this structure also user friendly and environmentally-protective in nature. Moreover, the need for manual assembly labor is reduced in that no wire has to be installed in order to maintain the pole key 40 in an initially retracted or closed condition prior to installation.

A further advantage derived in connection with the encompassing of the pole key 40 with the plastic film 46, and was not heretofore appreciated, resides in that the plastic film can be employed to retain the pole key 40 in its closed position in readiness for installation, whereas the wire tie only held the pole key in a shipping condition. The wire tie currently must be undone and the pole key repositioned for installation.

Figure 12:
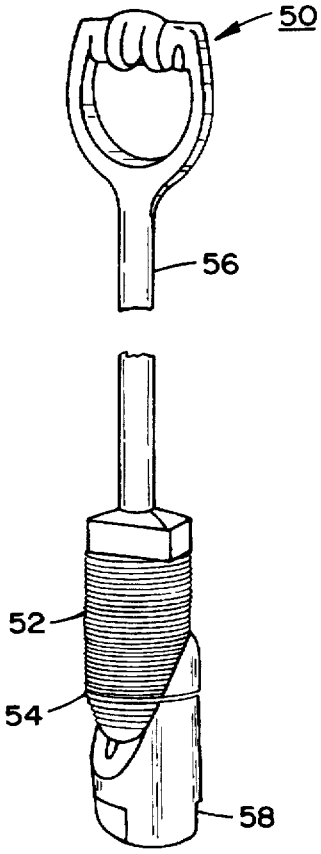
FIG.12 (PRIOR ART)
FIG. 12 illustrates an expanding rock anchor pursuant to the prior art, as shown in an initial closed condition.
Figure 13:
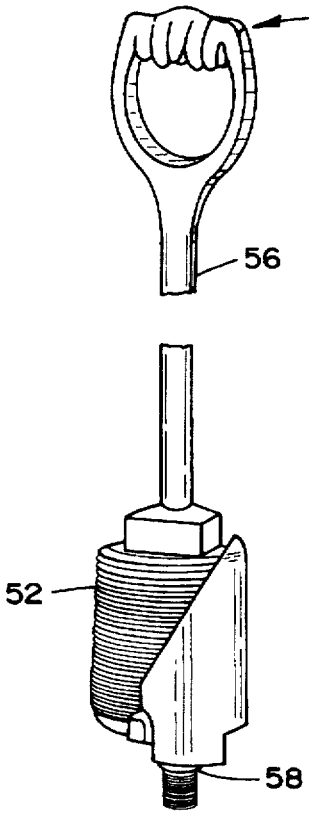
FIG.13 (PRIOR ART)
FIG. 13 illustrates the expanding rock anchor of FIG. 12 in its expanded condition.

With respect to the expanding rock anchor 50 as illustrated in FIGS. 12 through 15*d* of the drawings, which may be constituted of steel or cast iron, the expanding rock anchor as currently utilized, shown in FIG. 12 is also coated with an asphalt paint, and has the expandable wedges 52 thereof maintained in closed position by an encompassing wire 54, and covered with a burlap bag (not shown) before being delivered to a customer. Furthermore, the wedges 52 which are expandable in response to rotation of a rod member 56 having one end rotating in a threaded unit 58, as shown in FIG. 13 of the drawings, are normally covered with the burlap bag. As shown in FIGS. 15*a* through 15*d*, prior to expanding the rock anchor 50, a hole is drilled into rock strata to a suitable depth and commensurate diametral dimension, and at a drilling angle so that it may be utilized for anchoring a guy wire for a line pole or the like, or other suitable structures. Thereafter, upon the burlap bag having been removed, the anchor 50 shown in FIG. 12 is inserted to the required depth towards the bottom of the hole, and the rod member 56 turned to expand the wedges 52 of the anchor as shown in FIG. 13 of the drawings, thereby rupturing or breaking the wire to enable expansion of the wedges in a radial direction. Inasmuch as this is frequently difficult, it has often been the practice by customers to remove the wire 54, and to retain the wedges in their retracted position through the application of tape; a rather cumbersome procedure in view of the nature of the entire structure being covered with asphalt paint and this rendering the entire rock anchor not particularly user-friendly, and difficult to install in view of the inherent tendency of the wedges to expand.

Figure 14:
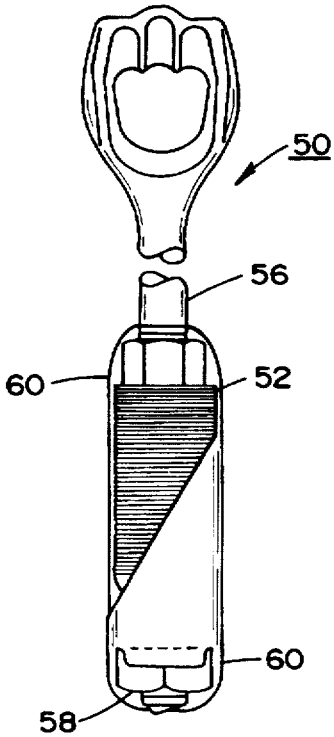
FIG. 14 illustrates in a view, similar to FIG. 12, the expanding rock anchor modified pursuant to the invention.
Figures 15A, 15B, 15C, 15D:
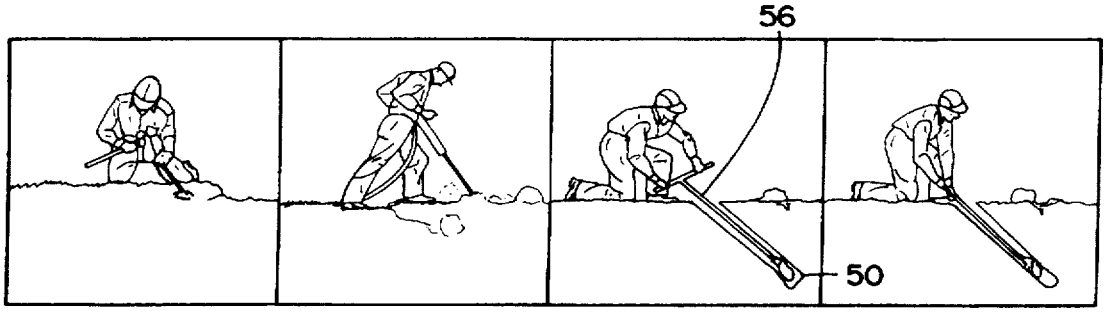
FIGS. 15*a* through 15*d*, respectively, illustrate steps in the method of installing the expanding rock anchor in a rock strata.

As shown in FIG. 14 of the drawings, the foregoing problem encountered in current expandable rock anchors 50 is ameliorated or eliminated in that the rock anchor in its closed or wedge-retracted initial condition has the wedge portion and at least the lower end tightly encased by a plastic shrink-wrap film 60, similar to the previous anchor embodiments, which will eliminate the need for applying asphalt paint, and the encompassing wire and burlap bag, thereby simplifying the assembly thereof and its installation, with the rock anchor 50 being more readily insertable into the ground towards the bottom of the hole drilled in the rock strata. This, heretofore, has been subject to difficulties due to the tendency of the wedges to expand prematurely or to engage the surface of the drilled hole. This drawback is eliminated by the encasement of the structure with the plastic shrink-wrap film 60 pursuant to the invention, which not only forms the unique assembly with the expandable rock anchor, but also imparts a smooth sliding surface to the anchor structure during insertion into the drilled hole, as shown in FIGS. 15*a* through 15*d*.

Figure 16:
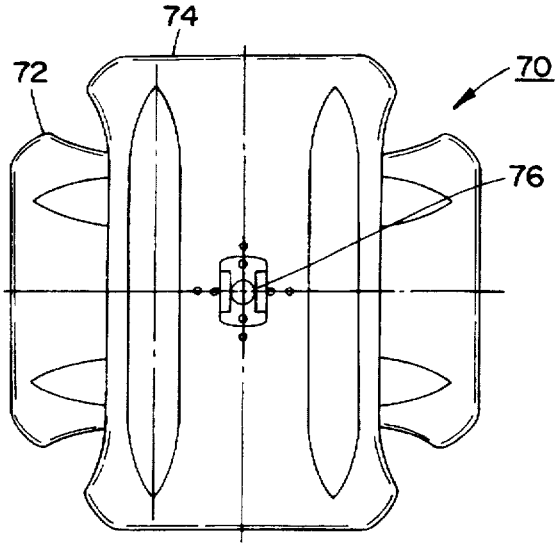
FIG. 16 illustrates a top plan view of a cross-plate anchor pursuant to the present state of the art.
Figure 18:
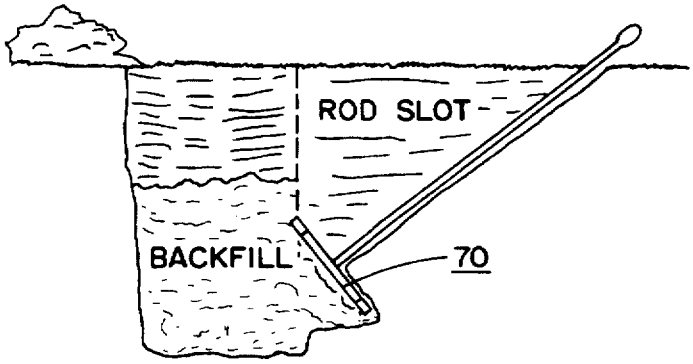
FIG. 18 illustrates the cross-plate anchor as installed in a trench formed in the earth.

Reverting to the embodiment for a cross-plate anchor 70 as shown in FIG. 16 of the drawings, in that instance rivets are employed to connect the two mutually perpendicularly arranged anchor plates 72, 74 and nut retainer 76, with the anchor being inserted into the ground by means of a trench as shown in FIG. 18 of the drawings. The plates, upon being riveted together pursuant to the current practice, are then coated with asphalt paint, as in the previous embodiments, thus rendering the structure subject to the same drawbacks as encountered with the other currently employed anchors.

Figure 17:
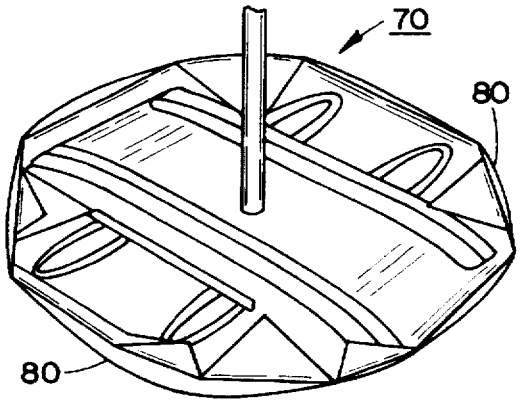
FIG. 17 illustrates a cross-plate anchor modified pursuant to the invention.

Pursuant to the present invention, as shown in FIG. 17 of the drawings, the rivets and holes therefor have been eliminated, which will render the structure somewhat stronger, and the entire cross-plate anchor consisting of the two plates is encased with a plastic shrink-wrap film 80, as in the other anchor embodiments. This, of course, will eliminate the necessity for having to coat the surfaces of the plates with asphalt paint, rendering the entire structure simpler and stronger, while being more compatible with the environment upon being inserted into the ground as shown in FIG. 18 of the drawings. In that instance, a trench is dug for the plates and a second perpendicular trench for a rod which extends outwardly to above ground, and with the cross-plate anchor being secured by means of backfilling of the dug trench, as is well known in this technology.

Instead of employing a plastic film, such as a shrink-wrap film as the anchor-encasing medium, in accordance with the invention it is also possible to employ netting, preferably a netting constituted from a plastic material; or a textile wrap. In those instances, the anchors may be painted with the asphalt paint for purposes of shipping and storage; however, the need for connecting wires has been eliminated. Also, rather than applying a coating of asphalt paint, it may be expedient to arrange the anchors with their encasing packaging materials in suitable water-proof packages or containers which are adapted to be removed prior to installing the anchors, in order to accomplish the same results.

From the foregoing, it becomes readily apparent that currently employed anchors of the types described hereinabove; in effect, expanding earth anchor having expandable blades or wedges supported on a base, expandable rock anchors; expandable pole key anchors and cross-plate anchors are each improved and simplified with regard to their manufacture assembly by eliminating the need for coating all of the surfaces with an asphalt paint, eliminating the need for wires to hold anchor components in a retracted condition prior to and during insertion into the dug or drilled holes in the soil or rock strata, by tightly encasing the anchor structure with a plastic shrink-wrap film or other comparably suitable packaging materials as described hereinabove, retaining the components in position without the need for wires or by eliminating rivets, while rendering the entire assemblies user friendly and environmentally-safe, and concurrently eliminating manufacturing and assembling steps to render them more economical.

While there has been shown and described what are considered to be preferred embodiments of the invention, it will, of course, be understood that various modifications and changes in form or detail could readily be made without departing from the spirit of the invention. It is, therefore, intended that the invention be not limited-to the exact form and detail herein shown and described, nor to anything less than the whole of the invention herein disclosed as hereinafter claimed.

What is claimed is:

1. An anchoring device for securing structures, said anchoring device being anchorable in the earth or rock strata and comprising, in combination:

(a) metallic anchor means insertable into and fastenable in the earth or rock strata, said anchor means being adapted to be connected to said structures;

(b) and protective packaging means tightly encasing said metallic anchor means so as to form in permanent connection therewith an integrally bound encompassing arrangement prior to and during insertion of said metallic anchor means into the earth or rock strata whereby at least portions of said arrangement are located unitarily within said earth or rock strata.

2. An anchoring device as claimed in claim 1, wherein said packaging means comprises a plastic film.

3. An anchoring device as claimed in claim 2, wherein said plastic film comprises a shrink-wrap film.

4. An anchoring device as claimed in claim 3, wherein said plastic shrink-wrap film is selected from the group of materials consisting of polyethylene, polyvinylchloride, polyester and polypropylene.

5. An anchoring device as claimed in claim 1, wherein said packaging means comprises a netting material.

6. An anchoring device as claimed in claim 5, wherein said netting material is constituted of plastic material.

7. An anchoring device as claimed in claim 1, wherein said packaging means comprises a textile or fabric wrap.

8. An anchoring device as claimed in claim 1, wherein said metallic anchor means and packaging means are adapted to be housed in a water-proof container during shipping and storage, wherein said container is removable prior to installation of said anchoring device.

9. An anchoring device as claimed in claim 1, wherein said metallic anchor means comprises a base member and a generally cup-shaped member forming an expandable earth anchor having a plurality of downwardly extending and radially outwardly expandable wedge-like blade portions supported on said base member.

10. An anchoring device as claimed in claim 9, wherein said base member and said cup-shaped member are arranged in superimposed relationship, said packaging means encompassing said members so as to retain said members in fixed position with respect to each other prior to said blade portions being radially expanded.

11. An anchoring device as claimed in claim 9, wherein said base member and said cup-shaped expandable member are each constituted of sheet metal.

12. An anchoring device as claimed in claim 1, wherein said metallic anchor means comprises a cylindrical rock anchor structure having radially outwardly expandable wedge surfaces adapted to grippingly engage a wall of a bore hole drilled in rock strata responsive to rotation of a threaded rod extending axially from said cylindrical structure, said packaging means tightly encompassing said cylindrical structure so as to restrain the wedge surfaces in the retracted position thereof prior to imparting rotation to said rod for radially expanding said wedge surfaces.

13. An anchoring device as claimed in claim 7, wherein said cylindrical rock anchor structure is constituted of steel or cast iron.

14. An anchoring device as claimed in claim 1, wherein said metallic anchor means comprises a pole key having outwardly extendable plate elements, said anchor means being encompassed by said packaging means in the initially retracted position of said plate elements to facilitate insertion of said pole key into the earth prior to outward extension of said plate elements.

15. An anchoring device as claimed in claim 1, wherein said metallic anchor means comprises a pair of superimposed plate member arranged at right angles to each other so as to form a cross-plate anchor configuration, said packaging means tightly encompassing said plate member so as to retain said plate members in the cross-plate anchor configuration.

* * * * *